US005513573A

United States Patent [19]

Sutton

[11] Patent Number: 5,513,573

[45] Date of Patent: May 7, 1996

[54] METHOD AND APPARATUS FOR GLOBAL RAPID TRANSIT

[76] Inventor: Gary E. Sutton, 1865 Caminito Ascua, La Jolla, Calif. 92037

[21] Appl. No.: 519,536

[22] Filed: Aug. 25, 1995

[51] Int. Cl.[6] ..... B61B 13/00

[52] U.S. Cl. ..... 104/138.1

[58] Field of Search ..... 104/138.1, 138.2; 105/365

[56] References Cited

U.S. PATENT DOCUMENTS

| | | | |
|---|---|---|---|
| 3,368,496 | 2/1968 | Falk et al. | 104/138.1 |
| 3,528,252 | 9/1970 | Gail . | |
| 3,605,629 | 9/1971 | Edwards | 104/138.1 |
| 3,720,065 | 3/1973 | Sherard . | |
| 3,934,420 | 1/1976 | Janelid et al. . | |
| 3,943,722 | 3/1976 | Ross . | |
| 4,148,260 | 4/1979 | Minovitch | 104/138.1 |
| 4,358,222 | 11/1982 | Landau . | |
| 4,431,349 | 2/1984 | Coursen . | |
| 4,516,878 | 5/1985 | Rebhan . | |
| 5,324,139 | 6/1994 | Wagner et al. . | |
| 5,433,155 | 7/1995 | O'Neill et al. | 104/138.1 |

*Primary Examiner*—Mark T. Le

*Attorney, Agent, or Firm*—Brown, Martin, Haller & McClain

[57] ABSTRACT

Subterranean tunnels extend deep into the Earth's crust between two points on the Earth's surface. A magnetically levitated rail transportation system operates in each tunnel. Gravity provides most of the energy needed to propel the trains. One or more magnetic accelerators in the tunnel provide the energy boost needed to compensate for frictional energy losses. Steam turbine-powered generators, disposed in the tunnels, provide electrical power to the magnetic levitation system and accelerators. The heat from the surrounding rock may be used to produce steam for powering the turbines. A machine for constructing the tunnels bores through solid rock and molten or partially molten rock. As the machine moves forward, it lays pipes that are fed from the surface through the newly-bored tunnel. The pipes carry chiller fluid that solidifies magma that comes into contact with the pipes. As a result, the machine bores through molten or partially molten rock and leaves a tunnel having hardened rock walls behind it as it moves. The chiller fluid is continuously pumped through the pipes from one end of the tunnel to the other, not only to maintain the tunnel walls in a solidified state but also to provide steam for powering the turbines.

8 Claims, 2 Drawing Sheets

METHOD AND APPARATUS FOR GLOBAL RAPID TRANSIT

BACKGROUND OF THE INVENTION

Passengers and cargo can be transported between continents separated by oceans only by air or sea. Aircraft are relatively fast, but they are energy-inefficient. Ships are slower, but they can carry large numbers of passengers and heavy cargo relatively economically.

Rail transportation is fast and relatively energy-efficient for carrying large numbers of passengers and heavy freight. Fast rail systems, such as the Japanese bullet train and the French TGV have been developed. Nevertheless, increasing operating speeds reduces energy-efficiency.

Aircraft, ships and trains all contribute to atmospheric pollution because, with the exception of those utilizing nuclear power, it is necessary to burn fossil fuels. Nuclear generating systems raise other problems, such as disposal of spent fuel.

Geothermal generators can provide energy cleanly and economically. Nevertheless, they must be located at a geothermally active site, and electrical power must be transmitted over long distances to power distant transportation systems.

It would be desirable to provide an intercontinental or global transportation system that is fast, non-polluting and energy-efficient. These problems and deficiencies are clearly felt in the art and are solved by the present invention in the manner described below.

SUMMARY OF THE INVENTION

In one aspect, the present invention comprises one or more subterranean tunnels that extend deep into the Earth's crust between two points on the Earth's surface. The tunnels have a generally parabolic or hyperbolic shape. A rail transportation system operates in each tunnel. Trains comprising one or more cars, which are preferably magnetically levitated, enter the tunnel at one end and accelerate downward under the power of gravity. Because frictional energy losses are low, the trains need only a relatively small boost of power to complete their journey from one end of a tunnel to the other. The primary source of energy is the potential energy of the train at the tunnel entrance. When the train reaches its maximum speed at the bottom or midpoint of the tunnel, the kinetic energy of the train propels it upward to the tunnel exit.

The present invention may further comprise one or more thermal-powered generators, such as steam turbine-powered generators, disposed in the tunnels. The heat from the surrounding rock may be used to produce steam for powering the turbines. The resulting electricity powers the train and magnetic levitation system. The electricity is preferably supplied to magnetic accelerators disposed near the generators. As the train passes the accelerator, a magnetic field provides a "push" (or pull) to accelerate the train. Power generated in excess of that needed to power the magnetic levitation system and accelerators can be routed to the surface for connection to electric utility power grids. Although steam turbine generators are preferred, any other type of generator known in the art that converts heat to electricity is also suitable.

In another aspect, the present invention comprises a machine for constructing the tunnels. The machine bores through solid rock and molten or partially molten rock (magma). As the machine moves forward, it lays a plurality of pipes that are fed from the surface through the newly-bored tunnel behind it. The machine spaces the pipes around the walls of the tunnel. The pipes carry chiller fluid that solidifies magma that comes into contact with the pipes. As a result, the machine bores through molten or partially molten rock and leaves a tunnel having hardened rock walls behind it as it moves. The chiller fluid is continuously pumped through the pipes from one end of the tunnel to the other, not only to maintain the tunnel walls in a solidified state but also to provide steam for powering the turbines.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figure 1:
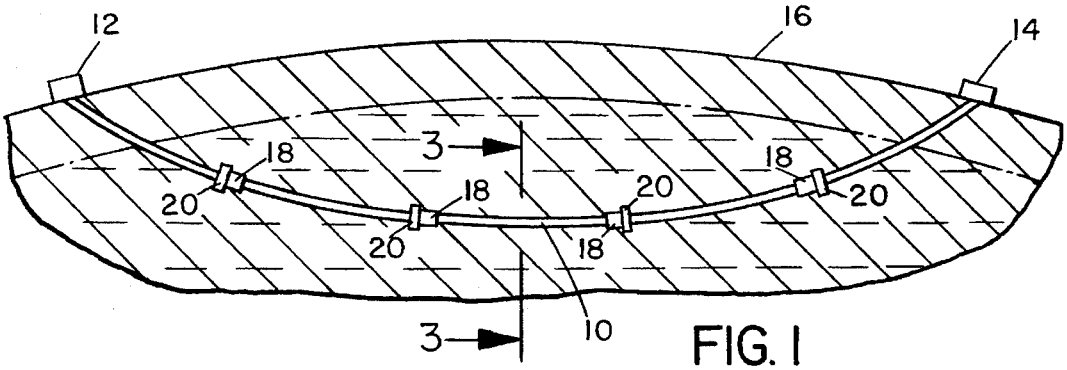
FIG. 1 illustrates a typical tunnel installation between two terminals on the Earth's surface.
Figure 2:
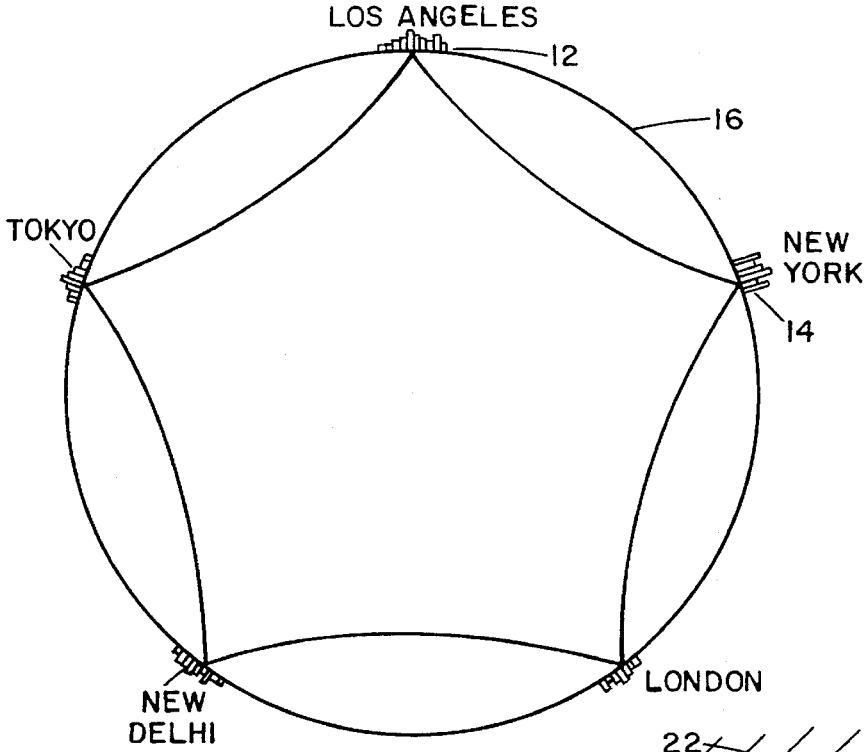
FIG. 2 schematically illustrates a global tunnel system.

As illustrated in FIG. 1 (not to scale), a subterranean tunnel 10 extends between a first terminal 12 and a second terminal 14 on the Earth's surface 16. As illustrated in FIG. 2 (also not to scale), terminals 12 and 14 are in distant cities, e.g., Los Angeles and New York, approximately 3,000 miles apart. Spaced along tunnel 10 are thermal-powered generators 18 and magnetic accelerators 20. Tunnel 10 extends to a depth of approximately 100 miles in a generally hyperbolic shape. As those skilled in the art will appreciate, the required depth is dependent upon the length of the tunnel. Nevertheless, the tunnel should reach a depth where sufficient heat can be extracted fro the surrounding rock to power generators 18 and accelerators 20, as described in further detail below.

Figure 3:
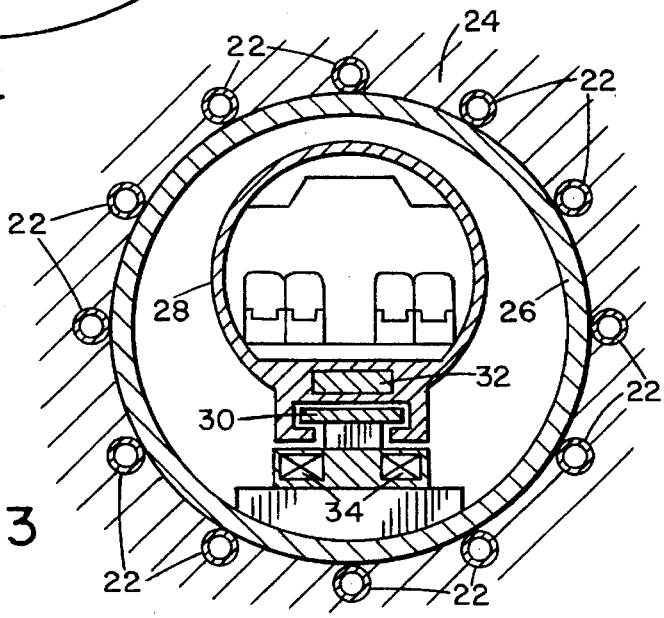
FIG. 3 is an enlarged sectional view taken on line 3—3 of FIG. 1, showing a typical tunnel.

As illustrated in FIG. 3, chiller pipes 22 line the walls of tunnel 10. A liquid, such as water, is pumped from terminal 12 or terminal 14 through chiller pipes 22 to the other terminal. The liquid absorbs heat from the surrounding magma or partially molten rock 24, which thereby solidifies to form the rock walls 26 of tunnel 10.

In tunnel 10, a train 28 is magnetically levitated on a rail 30 in any suitable manner known in the art. A magnet 32 in train 28 and electromagnets 34 in rail 30 repel each other to levitate train 28. One or both of magnets 32 and 34 may be superconducting magnets. As described in further detail below, train 28 is propelled in part by accelerators 20 spaced along track 30.

Figure 5:
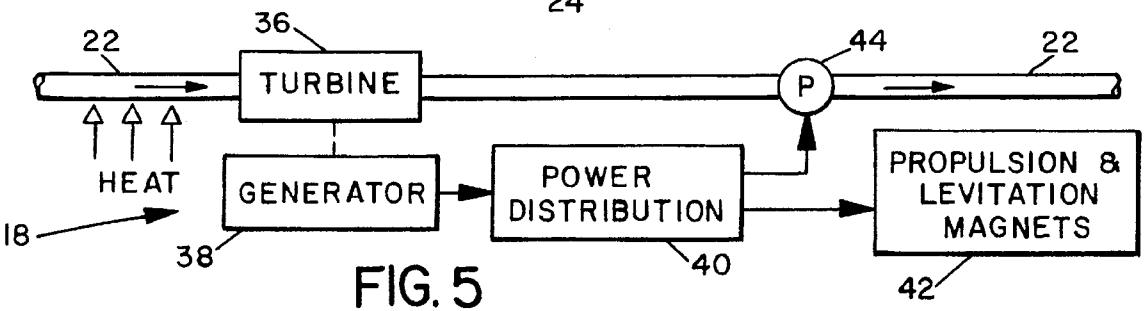
FIG. 5 is a diagram of the subterranean thermal-powered operating system.

As shown in FIG. 5, a chiller pipe 22 absorbs heat from the surrounding rock to generate electricity. Thermal generator 18 comprises a turbine 36 connected to a generator 38. Steam in pipe 22 rotates turbine 36 which, in turn, rotates generator 38. A power distribution network 40 comprising suitable transformers or other equipment distributes the resulting electrical power to the propulsion and levitation magnet system 42, which includes accelerators 20 (FIG. 1) and electromagnets 34 (FIG. 3). A portion of the power may be distributed to a pump 44 for pumping the liquid in pipe 22. Power may also be distributed to the surface via power lines (not shown) in tunnel 10 or via conductors (not shown) in rail 30. This excess power may be provided to the utility power grid (not shown) for public distribution.

In operation, train 28 enters tunnel 10 at, for example, terminal 12. The potential energy of train 28 accelerates it downward into tunnel 10. As train 28 accelerates to supersonic speeds, the potential energy is converted to kinetic energy, which then propels train 28 upward and out of tunnel 10 at terminal 14. Accelerators 20 include suitable switching and timing electronics (not shown) for activating them as train 28 passes. Accelerators 20 provide an energy boost to train 28 as it decelerates on the upward half of tunnel 10 that is sufficient to compensate for frictional energy losses. Train 28 thus emerges at terminal 14 at a very slow speed and continues to decelerate to a stop. No braking mechanisms are required because accelerators 20 provide only enough energy boost to compensate for frictional losses. In this manner, passengers or freight can traverse thousands of miles in minutes.

Figure 4:
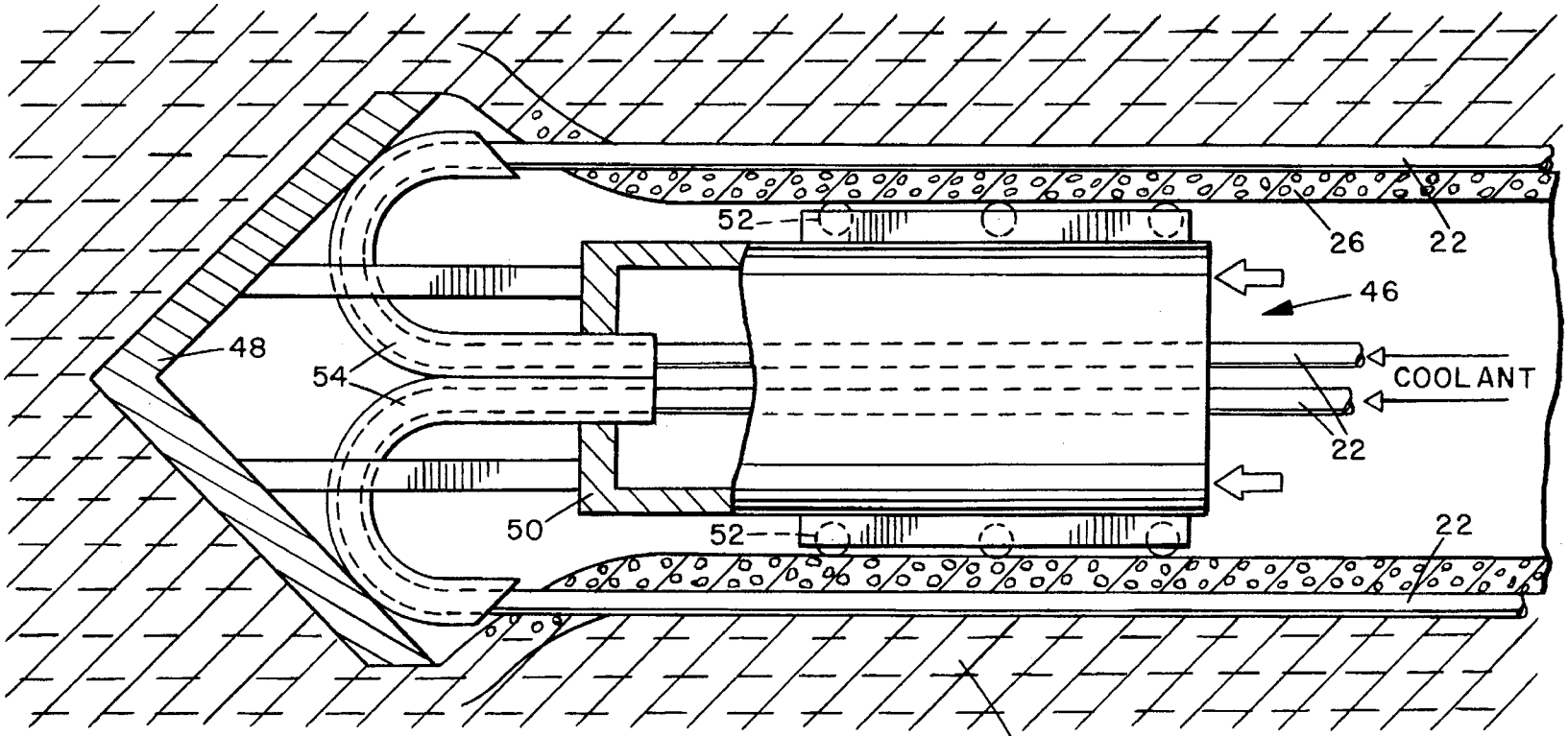
FIG. 4 is a partial sectional view showing a method for tunneling through magma.

A machine 46 for forming tunnels 10 is illustrated in FIG. 4. Machine 46 has a conical tip 48 for pushing its way through magma. Conical tip 48 may also have rotating carbide bits (not shown) for boring through rock and earth. The body 50 of machine 46 includes wheels 52 for propelling itself against the walls of the tunnel. Machine 46 may include any suitable power plant for transmitting power to wheels 52, including a power plant similar to that shown in FIG. 5 that receives steam from chiller pipes 22.

Chiller pipes 22 are fed through the tunnel to machine 46 as it moves forward in the direction of the arrows shown in FIG. 4. Chiller pipes 22 extend from the rearward end of machine 46 through one or more longitudinal openings in body 50 and radiate rearwardly through guides 54 at the forward end of machine 46. The fluid pumped through chiller pipes 22 solidifies magma 24. As magma 24 solidifies, chiller pipes 22 become embedded or partially embedded in the resulting rock walls 26. As machine 46 moves forward, it continually forms rock walls 26. Wheels 52 bear against the newly-formed rock walls to propel machine 46.

Machine 46 can install thermal-powered generators 18 and connect them to chiller pipes 22 as it forms tunnel 10, or workers can install and connect them after tunnel 10 has been formed.

The present invention provides a global rapid transit system that produces energy equal to or in excess of the amount needed to power it. The present invention does not consume natural resources or harm the atmosphere.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A transportation system comprising:

at least one subterranean tunnel;

said tunnel having walls and a plurality of fluid-carrying pipes embedded in said walls for receiving heat from said walls;

a rail extending through said tunnel for guiding a train thereon; and a propulsion system for converting said heat into electrical power sufficient to propel said train through said tunnel.

2. The transportation system claimed in claim 1, wherein said propulsion system comprises means disposed in said tunnel for magnetically levitating said train above said rail.

3. The transportation system claimed in claim 1, wherein said propulsion system comprises means disposed in said tunnel for magnetically accelerating said train.

4. The transportation system claimed in claim 1, wherein said propulsion system comprises a plurality of thermal-powered generators spaced in said tunnel.

5. The transportation system claimed in claim 4, wherein said thermal-powered generators receive heat from said pipes.

6. The transportation system claimed in claim 5, wherein said thermal-powered generators include steam turbines that receive steam from said pipes.

7. The transportation system claimed in claim 1, wherein said propulsion system comprises:

a plurality of thermal-powered generators in said tunnel; and levitating means disposed in said tunnel for magnetically levitating said train above said rail, said levitating means receiving power from said thermal-powered generators.

8. The transportation system claimed in claim 1, wherein said propulsion system comprises:

a plurality of thermal-powered generators in said tunnel; and accelerator means disposed in said tunnel for magnetically accelerating said train.

* * * * *